US005152669A

United States Patent [19]

Heinig et al.

[11] Patent Number: 5,152,669

[45] Date of Patent: Oct. 6, 1992

[54] TURBOMACHINE BLADE FASTENING

[75] Inventors: Roger W. Heinig, Cocoa Beach, Fla.; Donald W. Barnes, Charlotte, N.C.

[73] Assignee: Westinghouse Electric Corp., Pittsburgh, Pa.

[21] Appl. No.: 653,570

[22] Filed: Feb. 11, 1991

Related U.S. Application Data

[63] Continuation-in-part of Ser. No. 543,982, Jun. 26, 1990, abandoned.

[51] Int. Cl.[5] ..... F01D 5/30

[52] U.S. Cl. ..... 416/219 R; 416/248; 29/889.21

[58] Field of Search ..... 416/219 R, 220 R, 223 A, 416/248, DIG. 2; 29/889, 889.2, 889.21

[56] References Cited

U.S. PATENT DOCUMENTS 3,702,222 11/1972 Bernales ..... 416/219 R

FOREIGN PATENT DOCUMENTS

| | | | |
|---|---|---|---|
| 950557 | 10/1956 | Fed. Rep. of Germany | 416/219 R |
| 264401 | 6/1970 | U.S.S.R. | 416/219 R |
| 578115 | 6/1946 | United Kingdom | 416/219 R |
| 614678 | 12/1948 | United Kingdom | 416/219 R |
| 620877 | 3/1949 | United Kingdom | 29/889.21 |
| 677142 | 8/1952 | United Kingdom | 416/219 R |

OTHER PUBLICATIONS

"10 Ways to Attach Blades", A. T. Colwell and R. E. Cummings, Based on 'Turbine Engine Blading: Manufacturing Technique and Fastening Methods', Oct. 3, 1947, pp. 32–35.

*Primary Examiner*—Edward K. Look
*Assistant Examiner*—James A. Larson

[57] ABSTRACT

Larger cutting tools which have inherently greater strength can be used to form mounting grooves for side-entry rotor blades when the bottom-most neck of the groove is increased in width in the machining process. The larger width leaves a gap on both sides of the bottom-most neck of the root at a location away from load bearing surfaces.

5 Claims, 2 Drawing Sheets

TURBOMACHINE BLADE FASTENING

This is a continuation-in-part application of application Ser. No. 543,982, filed June 26, 1990, abandoned.

BACKGROUND OF THE INVENTION

1. Field of the Invention

This invention relates generally to turbine blade root design and, more particularly, to the mounting of turbine blades in side-entry grooves and methods for forming the grooves.

2. Description of the Related Art

A steam turbine can include a combination of low pressure, intermediate pressure, and/or high pressure steam turbine elements which are coupled together to provide a single power output. Each steam turbine includes a rotor having a plurality of rotating blades mounted thereon in grooves. Usually, the blades of a given row are identical to each other. The rotating blades of a row extend radially outwardly from an outer surface of the rotor, with the rows being spaced apart. The rotating blades of one row differ in shape from those of the other rows; most noticeably the rotating blades of each row, or stage, vary in length depending on position along the rotor.

Each rotating blade, regardless of row, has a foil portion extending radially outwardly from the rotor and a base portion for mounting the blade to the rotor. The base portion includes a root which is fitted into a mounting groove provided for each blade of a row, and can include a platform integrally formed at the proximal end of the foil portion. The foil portion has a tip at the distal end and may have a twist profile from the proximal end to the distal end, or may be parallel-sided. Sometimes, shrouds are provided at the tips as separately added or integrally formed components.

A stationary cylinder is coaxially supported around the rotor and has a plurality of stationary blades mounted on an inner surface thereof. The stationary blades are arranged in rows which, when the cylinder is assembled with rotor, alternate with rows of rotating blades. The stationary blades of one row are shaped differently from those of the other rows, although all stationary blades have a foil portion. Some stationary blades have a base portion which includes a root and a platform. Others have the foil portion welded directly into the blade rings with no root or platform.

Rotor blade grooves provided in the rotor for mounting the rotor blades are usually geometrically more complex than the mounting grooves provided for stationary blades. Moreover, the roots of the rotating blades and the rotor are subjected to substantially greater stresses than corresponding roots of stationary blades.

Some turbines have turbine rotor blades mounted in what are referred to as "side-entry" grooves provided in the rotor. When mounted, the rotor blades extend radially outwardly from the rotor in rows which are disposed circumferentially around the rotor. Instead of having a single annular groove for mounting the plurality of rotor blades which constitute a row, a side-entry groove arrangement includes, for a given row, a series of spaced apart side-entry grooves, each side-entry groove of the series being provided for each rotor blade of the row.

A typical side-entry groove starts at the outer surface of the rotor as an opening which tapers inwardly towards a bottom of the groove. A series of undulations are provided between the opening and the bottom of the groove symmetrically on opposite sidewalls of the groove. A typical root of a corresponding turbine blade has a shape which substantially conforms to that of the groove. The undulations provide a series of interlocking steps.

The resulting shape of the rotor grooves and blade root is sometimes referred to as a fir tree.

In a side-entry groove, the root is pushed into the groove along a path lying in a plane perpendicular to the turbine rotor radial direction, and therefore, an interlocking can be achieved. Tolerances for both root and groove are very precise. Root and groove contour tolerance envelopes typically allow variations of 0.006 inches (0.15 mm) along the non-contact surfaces, with much smaller variations permitted on the contact surfaces. Basically, a precise fitting between the root and the groove is required such that the maximum clearance between the root and the groove is extremely small.

There is a general reluctance to change rotor blade root and groove configurations once a particular design has been developed. This is because it may have taken months or even years of meticulous calculation to arrive at a particular design. Sometimes, slight variations in rotor blade root and groove profiles lead to unacceptable decreases in the function or performance of the blades or the rotor. Given that the tolerances between the root and the groove are critical, changes in the profile of either or both goes against conventional wisdom.

Ordinarily, the root of a side-entry rotor blade fits into the groove which has a shape nearly identical to that of the root. This is done in order to minimize losses associated with leakage of the motive fluid. An exception to this practice sometimes occurs in high-temperature applications, where clearances are introduced between the bottom of the root and the bottom of the groove to provide a passage through which a cooling medium can pass.

Fir-tree blade roots and their corresponding mounting grooves are widest at their locations nearest to the foil and narrowest at their locations nearest the rotor body. This is done in order to most efficiently exploit the material which is available to transmit loads from the blade to the rotor, and to provide for generous fillet radii which serve to minimize stress concentration effects.

Because the sides of the blade root are unobstructed during manufacture, the cutting devices (machine tools, grinding wheels, or broaches) which are used to make the root can be constructed to be arbitrarily massive and, stiff. Groove cutting, however, is relatively much more difficult. One problem associated with groove cutting is that the size of the cutting tool is necessarily restricted to the size of the groove which is being cut.

If the bottom neck of the groove is not sufficiently large, then the bottom-most portion of the groove cutter will be weak and flexible. Among the possible undesirable consequences are the following:

(1) the groove cutter may break off during the cutting operation, potentially rendering useless the rotor which is being machined; (2) flexing of the cutter will remove extra material from the bottom contact surfaces of the groove. When a blade is assembled into such a groove, the bottom lug will not carry its intended portion of the total load. The remaining lugs will then be forced to carry more than their intended load, with adverse effects on reliability and life of the blade attachment structure.

To avoid these undesirable consequences, it is frequently necessary to compromise the strength of the blade fastening design by making the bottom neck of the groove wider than would otherwise be ideal.

SUMMARY OF THE INVENTION

An object of the present invention is to provide an improved method of mounting turbomachine rotor blades, in which a larger, stronger cutting tool can be used for forming the rotor groove.

Another object of the present invention is to provide an improved turbomachine rotor and blade assembly, in which the bottom groove neck is substantially wider than the bottom root neck.

These and other objects of the present invention are met by providing a method of mounting on a rotor a side-entry blade having a fir-tree shaped root profile including a plurality of necks which decrease in width from top to bottom, the method including cutting a groove in the rotor in a shape substantially conforming to that of the blade root so as to include a plurality of necks which decrease in width from top to bottom, increasing the width of a bottom-most neck of the groove relative to a bottom-most neck of the blade, and sliding the blade root into the rotor groove with small clearances therebetween everywhere except at the bottom-most neck on the groove and rotor, where a space is formed on opposing sides of the groove and root.

Another aspect of the present invention involves providing a rotor and blade assembly including a plurality of side-entry rotor blades, each having a fir-tree shaped root profile including a plurality of necks which decrease in width from top to bottom, and a plurality of grooves formed in the rotor and receiving a corresponding side-entry blade root of a corresponding rotor blade, each groove having a shape substantially conforming to that of the blade roots so as to include a plurality of necks which decrease in width from top to bottom. A bottom-most neck of each groove has a larger width relative to a bottom-most neck of the blade root so that when a blade is fitted into a corresponding groove, a space is formed between opposing surfaces of the root and groove on opposite sides of the root.

These and other features and advantages of the improvement in turbomachine blade fastening of the present invention will become more apparent with reference to the following detailed description and drawings.

DETAILED DESCRIPTION OF THE PREFERRED EMBODIMENTS

Turbomachine rotors and blades are generally known and thus a detailed description of rotor components and blade components has been omitted.

Figure 1:
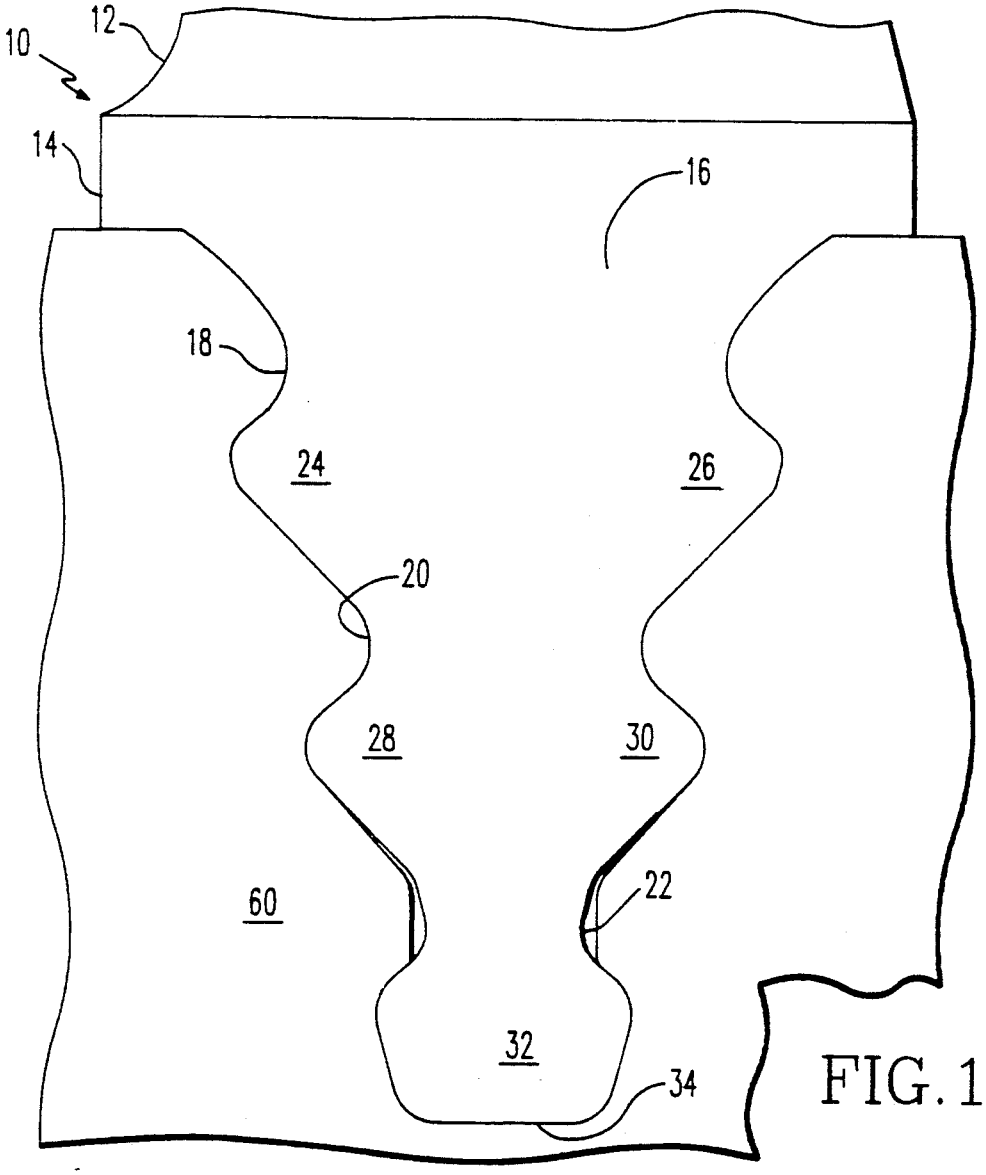
FIG. 1 is an end view of a side-entry rotor blade mounted in a groove of a rotor.

Referring to FIG. 1, a side-entry rotor blade is generally referred to by the numeral 10, and includes foil portion 12 (only partially shown) a platform portion 14 and a root portion 16 (hereinafter referred to as "root" 16).

The root 16 has a fir-tree shaped profile which includes a plurality of necks. In the particular example shown, there are three necks, 18, 20 and 22 which represent areas of reduced thickness of the root 16. Each neck is formed by virtue of the opposing side walls of the root converging together. Thus, looking at the Y-axis of the root 16 and beginning from the top of the root, the opposing side surfaces of the root continuously converge toward the Y-axis, and then diverge from the Y-axis to form lugs 24 and 26 which are symmetrically disposed about the Y-axis. As the side surfaces converge again toward the Y-axis, the second neck 20 is formed. Thus, the lugs 24, 26 are basically the protruding areas between necks 18, 20. From neck 20, the opposite side surfaces of the root 16 diverge and then once again converge to form a second set of lugs 28, 30. Where the side surfaces converge and then diverge once again, the bottom-most neck 22 is formed, so that the lugs 28, 30 are formed between the necks 20 and 22.

A bottom-most lug 32 is formed when the side surfaces once again diverge from the neck 22 and then gradually converge to the Y-axis and terminate in a bottom 34 of the root.

Figure 3:
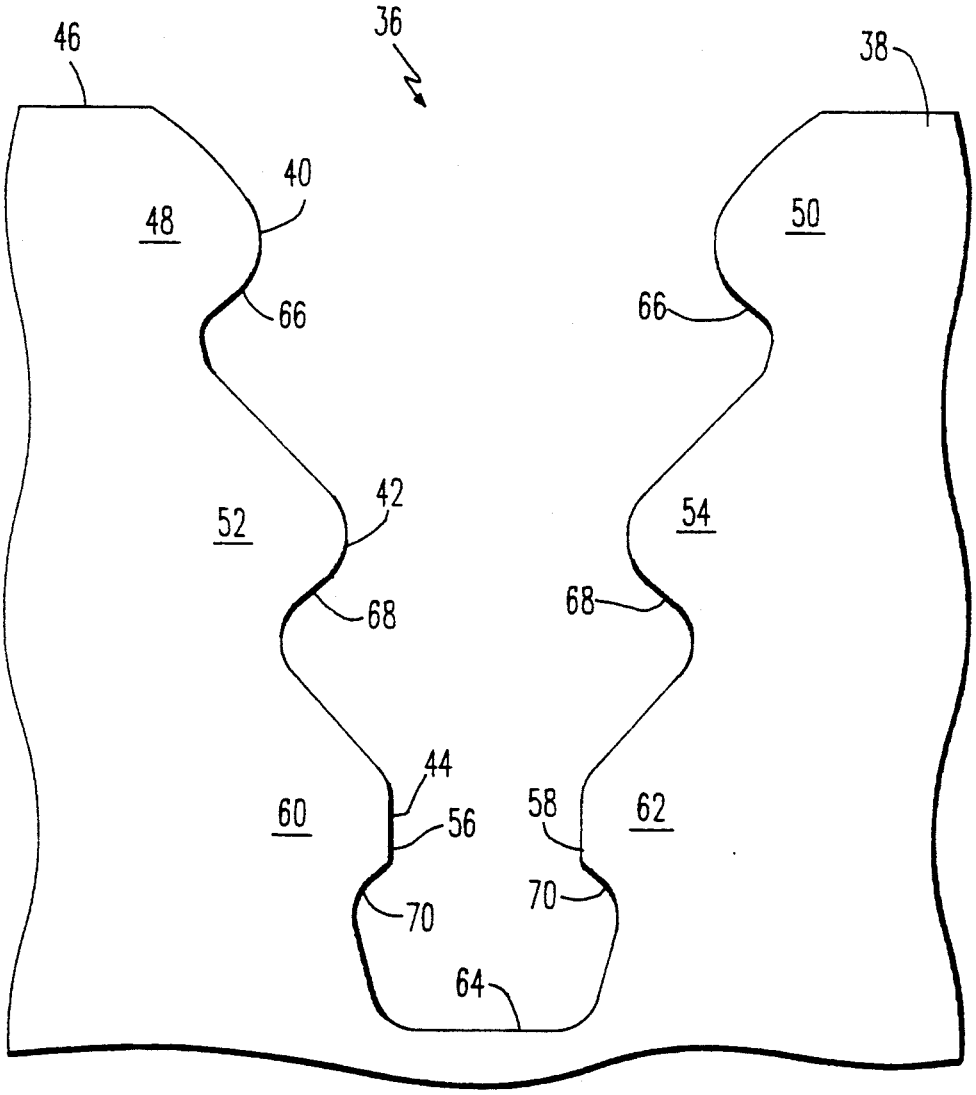
FIG. 3 is an end view of a rotor groove with the side-entry rotor blade of FIG. 1 removed.

Referring to FIG. 3, the groove 36 is formed in the rotor 38 and has a shape substantially conforming to that of the blade root so as to include a plurality of necks 40, 42, 44. The groove has opposite side surfaces which, from the top of the groove or outer surface 46 of the rotor, converge inwardly towards the Y-axis and then diverge away from the Y-axis, thereby forming a first set of lugs 48, 50. The side surfaces then converge towards the Y-axis and then diverge once again to form the second neck 42. As the opposite side surfaces diverge once again, a second set of lugs 52, 54 are formed. Then, the opposite sidewalls converge again towards the Y-axis and are machined to include substantially vertical linear portions 56 and 58 which form a wider neck 44 than what would normally be required. As shown in the drawings, the neck 44 is truncated and portions 56 and 58 form a wall which is substantially parallel to a centerline of the groove. The wider neck 44 permits access to the bottom groove by a stronger, less flexible cutting tool.

The opposite side surfaces diverge away from the Y-axis from the linear portions 56, 58 to thereby form a third set of lugs 60, 62. Then, the surfaces converge slightly towards the Y-axis and then bottom out in a bottom 64.

The necks of the groove and root thus diminish in width from top to bottom to define the fir-tree shape illustrated in the drawings. When the root 16 is slid into the rotor groove 36, very small tolerances are established such that in FIG. 1 the heavier line which forms both the profile of the root and the groove indicates that the two surfaces are too close to detect a gap by casual observation. These tolerances are generally maintained to minimize losses associated with leakage of the motive fluid and to minimize stress concentrations by virtue of an uneven load distribution.

In FIG. 1, the load bearing surfaces of the root 16 are those which are just below the necks 18, 20, 22. Similarly, load bearing areas or surfaces of the groove 36 are formed just below the groove necks 40, 42 and 44 and are indicated generally by the reference numerals 66, 68 and 70.

Figure 2:
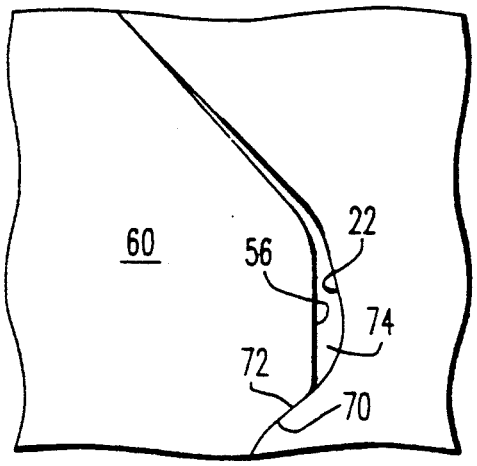
FIG. 2 is an enlarged view of the bottom-most neck area of the root and groove of FIG. 1.

FIG. 2 is an enlargement of the bottom-most neck area of the root and groove. The load bearing surface 70 of the groove is closely fitted to the load bearing surface 72 of the bottom-most lug 32 of the root 16. On the upper side of the lug 60, tolerances between the groove and the root can be slightly greater since these surfaces are not load bearing. Various techniques can be used to form the groove. A preferred technique includes machining in a first, rough cutting step, followed by a second semi-finishing cutting step, and then followed by a third, finishing cutting step.

A space 74 is formed between the linear portion 56 of the groove and the neck 22 of the root 16. This space is provided away from the load bearing surfaces 70 and 72, and is the result of additional machining or cutting away at the bottom-most neck of the groove 36. This space is provided on both sides of the neck 22 and thus allows for the entry of cutting tools of larger diameter and thus greater strength.

The present invention is particularly suitable for the last row of a low pressure steam turbine rotating at 1,800 rpm, with a 47 inch blade. This type of blade experiences a pressure drop smaller than do other blades elsewhere in the turbine. Another application is for a 32 inch blade in a 3600 rpm turbine.

The relatively large clearance between the bottom neck of the groove and the bottom neck of the root has several advantages. For example, if the groove were to conform to the shape of the root, the bottom groove neck would be reduced in size. This would reduce the strength of the corresponding groove cutter and increase its flexibility, since a smaller gap would be available through which the tool would pass. Also, if the root were to conform to the shape of the groove, the bottom root fillet radius would be substantially reduced. This would increase the stress concentration at the bottom root neck and thus increase susceptibility to failure by low-cycle fatigue, high-cycle fatigue and/or stress corrosion cracking.

One application which is particularly well suited to the present invention is, as previously mentioned, in the last rotating row of blades in a low pressure steam turbine. At this location, the centrifugal loads caused by the rotation of turbine blades about the rotor axis is particularly large. Because of these large loads, the necessity for efficiently exploiting the available load-carrying material is especially pronounced. Moreover, the last rotating row is characterized by relatively large annulus areas and by relatively small pressure drops across the rotating row. This means that leakage through the clearances introduced between the root and the groove is relatively insignificant.

Numerous modifications and adaptations of the present invention will be apparent to those so skilled in the art, and thus, it is intended by the following claims to cover all such modifications and adaptations which fall within the true spirit and scope of the invention.

What is claimed is:

1. A rotor and blade assembly for a last row of rotating blades comprising:

a plurality of side-entry rotor blades, each having a fir-tree shaped root profile including a plurality of necks which decrease in width from top to bottom; and a plurality of grooves formed in the rotor and receiving a corresponding side-entry blade root of a corresponding rotor blade, each groove having a shape substantially conforming to that of the blade root so as to include a plurality of necks which decrease in width from top to bottom with small clearances between the groove and the root everywhere except at a bottom-most neck;

said bottom-most neck of the groove being truncated and having a wall which is substantially parallel to a centerline of the groove and having a larger width relative to a bottom-most neck of the blade root so that when a blade is fitted into a corresponding groove, a space is formed between opposing surfaces of the groove and root on opposite sides of the root.

2. A rotor and blade assembly as recited in claim 1, wherein each blade root has a bottom and two opposite side surfaces including load bearing areas below each of the plurality of root necks and each rotor groove has a bottom and two opposite side surfaces including load bearing area below each of the plurality of groove necks, and wherein the space is formed immediately above the bottom-most load bearing areas of the root and groove.

3. A method of mounting on a rotor a side-entry blade for a last row of rotating blades, said blade having a fir-tree shaped root profile including a plurality of necks which decrease in width from top to bottom, the method comprising:

cutting a groove in the rotor in a shape substantially conforming to that of the blade root so as to include a plurality of necks which decrease in width from top to bottom;

increasing the width of only a bottom-most neck of the groove relative to a bottom-most neck of the blade root so that the bottom-most neck of the groove is truncated and has a wall which is substantially parallel to the centerline of the groove; and sliding the blade root into the rotor groove with small clearances therebetween everywhere except at the bottom-most neck of the groove and rotor, wherein a space is formed between opposing surfaces of the groove and root on opposite sides of the root.

4. A method as recited in claim 3, wherein the cutting step includes machining in a first, rough cutting step, followed by a second semi-finishing cutting step, and then followed by a third, finishing cutting step.

5. A method as recited in claim 3, wherein the space is formed away from load bearing surfaces of the root and groove.

* * * * *